US005829489A

United States Patent [19]

Kuji

[11] Patent Number: 5,829,489

[45] Date of Patent: Nov. 3, 1998

[54] TWO-LAYER PAPER-MAKING FABRIC HAVING AUXILIARY WEFT ON THE PAPER-MAKING SIDE

[75] Inventor: Takehito Kuji, Tokyo, Japan

[73] Assignee: Nippon Filcon Co., Ltd, Tokyo, Japan

[21] Appl. No.: 727,343

[22] Filed: Oct. 7, 1996

[30] Foreign Application Priority Data

Oct. 5, 1995 [JP] Japan ..... 7-293223

[51] Int. Cl.[6] ..... D03D 13/00

[52] U.S. Cl. ..... 139/383 A; 442/203

[58] Field of Search ..... 442/203; 139/383 A

[56] References Cited

U.S. PATENT DOCUMENTS

| | | | |
|---|---|---|---|
| 4,821,780 | 4/1989 | Tate | 139/383 A |
| 4,870,998 | 10/1989 | Westhead | 139/383 A |
| 5,013,330 | 5/1991 | Durkin et al. | 139/383 A |
| 5,482,567 | 1/1996 | Barreto | 139/383 A |
| 5,490,543 | 2/1996 | Fujisawa | 139/383 A |
| 5,555,917 | 9/1996 | Quigley | 139/383 A |
| 5,566,724 | 10/1996 | Trokhan et al. | 139/383 A |

*Primary Examiner*—Andy Falik
*Attorney, Agent, or Firm*—Foley & Lardner

[57] ABSTRACT

A two-layer woven fabric for paper-making where a paper-making side woven fabric and a running side woven fabric are combined together by pairs of auxiliary wefts which are placed adjacent to each of wefts of both fabrics. When one of a pair of the auxiliary wefts is placed over a paper-making side warp filling a concave portion formed by the warp, the other auxiliary weft is placed under a running side warp thereby connecting both the paper-making side and the running side fabrics together.

26 Claims, 11 Drawing Sheets

PRIOR ART

TWO-LAYER PAPER-MAKING FABRIC HAVING AUXILIARY WEFT ON THE PAPER-MAKING SIDE

BACKGROUND OF THE INVENTION

The present invention relates to a woven fabric for paper-making. In more detail, the invention relates to a woven fabric for paper-making used for forming fabric, felt, canvas or the like.

Woven fabric for paper-making has many requirements. These requirements include, for example:

(i) Surface smoothness including prevention of wire marks, and requirements for solving problems relating to better overall paper quality such as sufficient entanglement of paper fiber and for higher yield of paper-making;

(ii) Better abrasion resistance, longer service life of woven fabric; and (iii) Better stiffness, improved position stability, and good water filtration.

These requirements are related mutually in many respects. The requirement (i) is generally associated with problems which arise mainly from a paper-making side of a woven fabric, the requirement (ii) is generally associated with problems which arise mainly from a running side structure of a woven fabric, and the requirement (iii) is generally associated with problems which arise from structure of a woven fabric as a whole.

Many proposals have been made for coping with the requirement (i) concerning a paper-making woven fabric with one-layer warps and two-layer wefts. On the other hand, however, sufficient idea and technology have not been proposed for the requirement (ii), for better abrasion resistance of paper-making woven fabric. At best, abrasion-resistant type wefts are used on the running side of paper-making woven fabric to protect only warps from abrasion. Abrasion resistance of a paper-making woven fabric has recently been extremely critical, because paper production speed has been increased and the amount of fillers formulated has been increased and because neutral paper production has been increased. It is generally preferred that the wefts in the running side of a fabric exhibit the function of abrasion resistance from the viewpoint of position stability of the woven fabric used and its longer life. Abrasion of warps naturally results in the decrease of tensile strength and consequently the woven fabric elongates. Further, abrasion of the warps results in the warp cutting and consequently the woven fabric itself is cut or the woven fabric life comes to an end. Therefore, better abrasion-resistant type wefts are preferred.

To improve abrasion resistance of a woven fabric for paper-making, use of abrasion-resistant polyamide yarns has been tried as wefts in the running side. This process, however, does not remarkably change the woven fabric structure itself, but only utilizes properties of the material used. As a result, not only an epoch-making effect has not been obtained but a disadvantage has been apparent that the position stability of woven fabric is decreased by use of polyamide yarns.

Another attempt to improve abrasion resistance includes using larger diameter yarns as wefts in the running side of a paper-making fabric. Although some improvement was achieved, there were practical problems or defects such as loss of balance between wefts and warps, the resultant aggravation of crimp property, and consequent wire mark formation.

It was further devised that weave density of warps and wefts of a paper-making fabric was increased to decrease wire marks on papers made by the fabric. To do this, it was necessary to make the yarn diameters of both warps and wefts finer. Finer diameter of the yarns, however, lowers abrasion resistance, stiffness and position stability of a woven fabric of single-layer warps and double-layer wefts, which is commonly used and well known to the public at present.

On the other hand, use of larger diameter of the yarns for improving abrasion resistance, stiffness and position stability of a paper-making woven fabric, deteriorate surface smoothness, which results in formation of wire marks on papers produced. In other words there still exists a trade-off problem.

For the purpose of solving these problems, an attempt has been made in which a paper-making side woven fabric and a running side woven fabric are integrally connected by a binding yarn to form a two-layer woven fabric; therein, the paper-making side woven fabric and the running side woven fabric comprise, respectively, different types of warps and wefts.

That is, the paper-making side woven fabric uses warps and wefts with smaller yarn diameters to form a fine paper-making surface. On the other hand, the running side woven fabric uses warps and wefts with larger yarn diameters to form a highly abrasion-resistant running surface. The binding yarn does not constitute a woven fabric of either side. In other words, if the binding yarn is a weft-binding type yarn, the binding yarn crosses over a warp in the paper-making side woven fabric and then runs under a warp in the running side woven fabric. This is different from a ground yarn which constitutes a woven fabric by crossing over and under warps in the same side fabric.

FIG. 7 is a design diagram illustrating a repeating unit of a conventional two-layer woven fabric. FIG. 8 is a cross-sectional view taken along at a line 7—7 of FIG. 7 in a weft direction. FIG. 8 also shows adjacent repeating units connecting to the repeating unit shown in FIG. 7. The paper-making side fabric A shown is a 2-shaft plain weave fabric, whereas the running side fabric B shown is a 3-shaft fabric having larger warps and wefts than those of the paper-making side fabric. The weave density of warps and wefts of the two-layer fabric shown in FIGS. 7 and 8 are different between the both side fabrics A and B.

In FIGS. 7 and 8, a warp is shown in Arabic numerals, e.g., 1, 2 or 3. The same number is given for both a paper-making side warp and a running side warp placed in the same vertical position. A weft is shown in an Arabic numeral with a prime, e.g., 1', 2' or 3'. The same numeral is given for both a paper-making side weft and a running side weft placed in the same vertical position. A binding yarn is shown in an Arabic numeral with a double prime, e.g., 1", 2" or 3".

In FIG. 7, mark x in a box shows the position where a paper-making side warp is placed over a paper-making side weft. Mark ○ in a box shows the position where a running side warp is placed under a running side weft and is woven together with the paper-making side weft by a binding yarn. Mark ▲ in a box shows a position where a binding yarn is placed over a paper-making side warp. Mark Δ in a box shows the position where a binding yarn is placed under a running side warp and connects the running side woven fabric with the paper-making side woven fabric.

This scheme has not been satisfactory, however, because, as shown in FIG. 8, a concave portion 51 in the surface of paper-making side woven fabric is formed at a connecting part where the binding yarn 1" crosses over the warp 1 in the paper-making side, due to the fact that the binding yarn 1" pulls the paper-making side fabric to the running side. Then the concave portion 51 generates a wire mark on a produced paper in a way that the concave shape is transferred to the paper.

Another problem observed was void formation between both side woven fabrics and resultant separation of both side woven fabrics, because the strength of the binding yarn deteriorates due to internal abrasion.

SUMMARY OF THE INVENTION

In view of the problems described above, the purpose of the present invention is to provide a two-layer woven fabric having improved abrasion resistance and improved wire mark properties, which is formed by joining a paper-making side woven fabric and a running side woven fabric. Both paper-making side and running side fabrics can be integrally connected by auxiliary wefts which act as binding yarns and may comprise same or different types of warps and wefts in both side woven fabrics, respectively. The two-layer woven fabric of the present invention does not generate concave portion on the surface of paper-making side at the connecting parts where an auxiliary weft acting as a yarn for binding both sides of fabrics can be woven into the fabric on the paper-making side surface.

Specifically, the paper-making side woven fabric of the present invention can be more than three-shaft (more than three warps and three wefts are present in a repeating unit) and may have long crimps of warps on the paper-making side. Auxiliary wefts are to be placed between the wefts of both paper-making side and running side fabrics and can be woven with warps of at least the paper side fabric to connect both fabrics. A pair of auxiliary wefts may be placed between each of wefts. When one of a pair of auxiliary wefts is woven over a warp of the paper-making side fabric (hereinafter referred to as "paper-making side warp"), the other may be woven under a warp of the running side fabric (hereinafter referred to as "running side warp"). Further according to this feature, the portions where one pair of auxiliary wefts can be woven together with the paper-making side warps appear alternatively on the paper-making side surface, and an auxiliary weft weave pattern formed on the paper-making side surface consists of substantially single auxiliary weft. In other words, when one of a pair of auxiliary wefts is placed over a paper-making side warp, the other one is placed under a running side warp disposed at the same or closely the same vertical position. There may be distance between the places where each of a pair of auxiliary wefts is woven into the paper-side fabric, and the distance of the places can consist of several warps.

A repeating unit formed by a pair of auxiliary wefts and paper-making side and running side warps may be formed. The number of paper-making side warps, counted in the direction of wefts, in a repeating unit formed by an auxiliary weft may have twice as many warps as the number of the paper-making side warps in a repeating unit (number of shafts) of a paper making side fabric. Each of a pair of auxiliary wefts may be woven into the fabric in shifted positions with a distance of certain number of the paper-making side warps in the repeating unit in the weft direction. Each of the auxiliary wefts can be woven together with the running side warps in the parts located closest to the paper-making side in a form of crossing of the auxiliary wefts with and under the running side warp. Further, the pair of auxiliary wefts may be placed between and adjacent to all of paper-making side wefts.

The running side of the two-layer fabric of this invention may be of a weft-wearing type in which long crimps of the running side wefts are formed on the running side. The weave density of the warp of paper-making side warp and running side warp can be identical with the weave density of wefts of paper-making side wefts and running side wefts. The running side woven fabric may have the same weave pattern as the paper-making side woven fabric. A plurality of auxiliary weft pairs can be placed between wefts. The plurality of auxiliary weft pairs placed can have different weave patterns.

BRIEF DESCRIPTION OF THE DRAWINGS

FIG. 6B continues to FIG. 6A at the position of weft 25'.

PREFERRED EMBODIMENTS OF THE INVENTION

Figure 1:
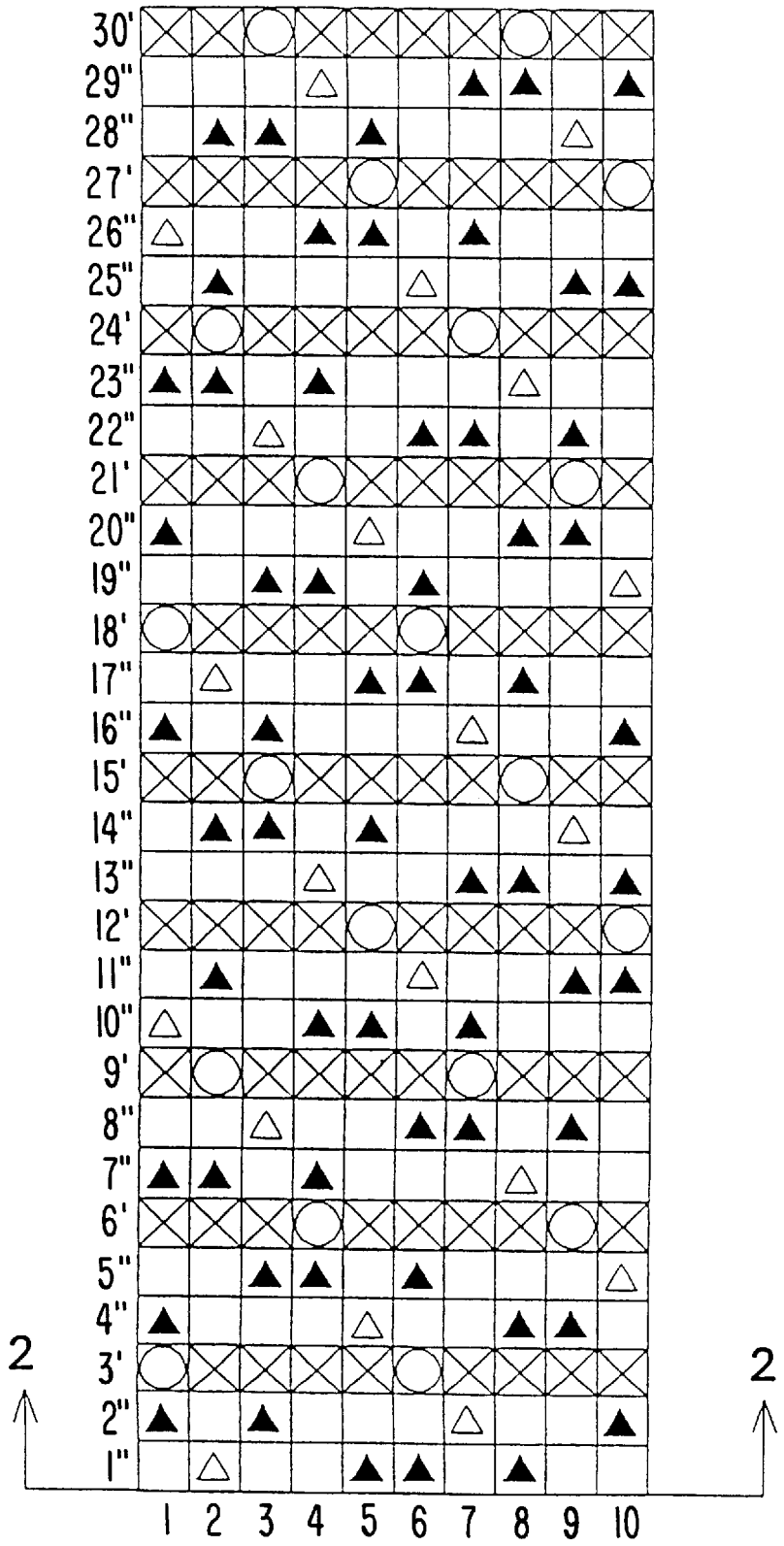
FIG. 1 is a design diagram illustrating a repeating pair of an example of the present invention.

Herein, a "knuckle" means a crossing part where a warp and a weft cross and are woven. A "weft knuckle" is a knuckle where a weft appears on the surface of a woven fabric while being woven with a warp. A "warp knuckle" is a knuckle where a warp appears on the surface of a woven fabric while being woven with a weft. A weft knuckle of a running side woven fabric, consequently, is a knuckle where a weft appears on the paper-making side surface while being woven with a warp, and a warp knuckle of a running side woven fabric is a knuckle where a warp appears on the running side surface while being woven with a weft. Likewise, a weft knuckle of a paper-making side woven fabric, consequently, is a knuckle where a weft appears on the paper-making side surface while being woven with a warp, and a warp knuckle of a paper-making side woven fabric is a knuckle where a warp appears on the paper-making side surface while being woven with a weft.

The portion of either warp or weft between two knuckles is a crimp.

An auxiliary weft is not a weft which constitutes a fabric, but a weft placed in a concave part of a surface of a fabric to make the surface smoother. Such a concave part can be formed at a portion of two adjacent warps crossing with each other where a first warp is extended from over a first weft to under a second weft which is adjacent to the first weft and a second warp is extended from under the first weft to over the second weft. A concave part can be formed at a portion where a warp sinks downward by being woven with a weft. The auxiliary weft is not a so-called floating yarn, but a weft woven into fabric.

One of characteristics of the present invention is integration of a paper-making side woven fabric of more than three-shaft (fabric in which three warps and three wefts form a repeating unit) and a running side woven fabric consisting of the running side warp and weft by connecting both fabrics with an auxiliary weft, where, the paper-making side woven fabric consisting of the paper-making side warp and weft, has a long crimp of a paper-making side warp formed on the paper-making side. The auxiliary weft makes the surface smooth as its original function and acts as a binding yarn at the same time. This structure allows the paper-making side to form a fine surface of paper-making by use of fine yarn diameter warp and weft. On the other hand, the running side woven fabric has a long crimp of a running side weft formed on the running side. This allows the running side woven fabric to form highly abrasion-resistant running surface. Further, by use of larger yarn diameter warp and weft, the abrasion resistance will be increased.

By placing an auxiliary weft between the wefts in the paper-making side woven fabric, a paper-making side woven fabric with smooth surface can be formed, better water filtration property is ensured, improved fabric position stability and less water holding capacity are realized.

Since the paper-making side woven fabric has long crimps of warps in the paper-making side in parallel, the long crimps of warps extended in parallel tend to sink eventually between knuckles because they are pushed downward by the weft knuckles weaving them. In other words, the weft knuckles protrude between the warps causing the surface to become uneven. This unevenness (production of convexe and concave portion) occurs more remarkably with higher-numbered shaft fabric.

When stock slurry is fed to paper-making woven fabric which is running, the stock fiber is inevitably oriented in the running direction, is piled between long crimps of the warp pieces which are in parallel with one another, or goes away in a downward direction. Fiber clogging between long crimps of the warps lowers the water filtration capability and consequently requires higher vacuum pressure for water removal. As the result, more wire marks tend to appear.

The inventor has earlier discovered that auxiliary weft with smaller yarn diameter should be placed between the paper-making side weft pieces to solve this problem. For the purpose of improving paper feed stock holding capacity, weft yarn weave density should be increased, which causes a problem of lower water filtration capability. For the purpose of ensuring good water filtration capability, it is preferable that the diameter of the auxiliary weft is smaller than that of the paper-making side weft.

Adding auxiliary weft gives a paper-making woven fabric unique function which a conventional paper-making woven fabric cannot give.

First, the surface of paper-making side woven fabric can be made smooth by placing an auxiliary weft in a concave portion. Such a concave portion may be formed at a crossing portion of two adjacent warps, where one of two adjacent paper-making side warps is extended from over a first paper-making side weft to under a second paper-making side weft which is adjacent to the first weft and the other paper-making side warp is extended from under the first paper-making side weft to over the second paper-making side weft.

Second, the concave portion can be filled and the retainability of stock can be improved by placing an auxiliary weft in a concave portion or portions. Such a concave portion may be formed at a crossing portion of two warps which are not adjacent but close (e.g., one warp is adjacent to a third warp and the other warp is adjacent to the third warp), where one of the two paper-making side warps is extended from over a first paper-making side weft to under a second paper-making side weft which is adjacent to the first weft and the other paper-making side warp is extended from under the first paper-making side weft to over the second paper-making side weft.

Further, auxiliary wefts can be extended over paper-making side warps which are extended between paper-making side weft knuckles to fill concave and convex parts which occur between the knuckles where paper-making side warps sink downwardly.

A further characteristic of the present invention is that an auxiliary weft fills concave portion on the paper-making surface, thus improving the smoothness, and simultaneously connects the paper-making side woven fabric with the running side woven fabric functioning as a binding yarn. In other words, the auxiliary weft and the binding yarn are formed by the same yarn. This is achieved by placing a pair of auxiliary wefts between regular wefts of a paper-making side fabric and a running side fabric. An auxiliary weft fills concave portions which is the original function of the auxiliary weft, and also achieves the binding function. When one of a pair of auxiliary wefts is woven with a paper-making side warp so as to fill concave portions on the paper-making face (original function), the same auxiliary weft pulls down (to the running surface side) and binds the paper-making side woven fabric, while the other auxiliary weft is woven together at the same place with a running side warp and pulls up the running side woven fabric to the paper-making side (binding function). A smooth paper-making face is formed as if one auxiliary weft were placed, by placing two the auxiliary weft as described above; thereby, the portion where the one of a pair of auxiliary wefts is woven together with a paper-making side warp, or the portion where one of the pair functions as an auxiliary weft, appears alternately as if one auxiliary weft were placed.

Experiments have confirmed that a two-layer paper-making woven fabric using conventional binding yarns cannot avoid wire mark generation, because the binding yarns pulled down the paper-making face; concave portion were consequently formed in the binding parts and the concave portion were transferred on paper produced. According to structure of the present invention, however, auxiliary wefts and binding yarns are formed with identical yarns. Consequently, the positions of a paper-making side woven fabric on which auxiliary wefts are placed are simultaneously the binding parts. Thus, the binding parts according to the present invention have no adverse effects since the positions where auxiliary wefts are placed are the positions where binding yarns should be placed originally, unlike the case of conventional two-layer woven fabric for paper-making wherein the binding yarns appear over paper-making side warps of the paper-making surface, forming concave portion on the paper-making surface. It should be noted, however, that it is not necessarily sufficient to place yarns in the positions where they are supposed to be placed originally.

It is also important that all the auxiliary wefts function as binding yarns as described above. Unevenness occurs on paper-making face in the case where not all but a part of the auxiliary wefts are designed to function as a binding yarn.

The mechanism is different between a group of the auxiliary wefts functioning as binding yarns and another group of the auxiliary wefts not functioning as binding yarns, because the former group of the auxiliary wefts is pulled downward toward the running side stronger than the latter group is.

This is understood, for example, by the fact that the paper-making side woven fabric, according to the technology disclosed in, e.g., Japanese Laid-open Patent No. 58-18496/1983, has not been usable practically due to the defect of concave portion formed in the places where a part of the auxiliary wefts is used as binding yarns.

In the present invention, however, only one kind of auxiliary wefts may be used as binding yarns, if there are more than two kinds of auxiliary wefts used to form different weave patterns. It is desirable that all the auxiliary wefts of the same kind are designed to function as the binding yarn. It is also preferable to avoid that two or more groups of auxiliary wefts which function or do not function as binding yarns are mixed in the same kind or in the same weave pattern of fabrics.

Another characteristic of the present invention is that all the auxiliary wefts in each repeating unit can pull down the paper-making side surface toward the running side by the same force and that the paper-making side surface can consequently be made smooth. Every paper-making side warp in a repeating unit in the weft direction is woven together with auxiliary wefts. A repeating unit of woven part, where auxiliary wefts are woven with paper-making side warps, is formed on the paper-making surface by every repeating unit of wefts. This is achieved by the case, for example, wherein the number, in the weft direction, of the paper-making side warps in a repeating unit formed with auxiliary wefts is twice as many as the number, in the weft direction, of the paper-making side warps in a repeating unit formed with paper-making side wefts. Both of a pair of auxiliary wefts which are disposed between paper-making side wefts are disposed in a shift of the number of the paper-making side warps in a repeating unit which is formed with paper-making side wefts in the weft direction.

This arrangement makes it possible for every repeating unit of the paper-making face to be pulled down in all the repeating units. Owing to the same weave pattern, the same force under the same condition is applied.

A strong force of connecting a paper-making side woven fabric with a running side woven fabric is also one of characteristics of the present invention. According to the present invention, two binding yarns are used between the paper-making side wefts to combine a paper-making side woven fabric and a running side woven fabric. Thus, more binding yarns are used in the present invention, which results in a stronger connecting force being supplied to connect the two fabrics than a conventional combined fabric wherein only one binding yarn was used between two adjacent paper-making side wefts.

The stronger binding force produces less opportunity of internal abrasion of a binding yarn caused by being rubbed by and between the paper-making side woven fabric and the running side woven fabric; thereby, less problems such as void space formation or separation occur.

Another characteristic of the present invention is that a crossing position of an auxiliary weft with a running side warp is one that the running side warp is positioned at the closest proximity to the paper-making side among other warps. This structure gives an advantage that an auxiliary weft is protected from wearing to a greater extent.

An auxiliary weft is originally designed to be woven together with a paper-making side warp and should be held and maintained at the position. In the present invention, however, an auxiliary weft is to be woven together with a running side warp as well. As the result, the auxiliary weft is pulled upward toward the paper-making side and held at the paper-making side firmly.

The weave pattern of the running side woven fabrics of the present invention is not specifically limited. Weft wear type weave pattern is preferable, however, since warp abrasion can be prevented more effectively and the tensile strength of warps is not lowered.

Likewise, weave density of each yarn, yarn diameter, material and other characteristics are not specifically limited. It is preferable, however, for all kinds of yarn to have the same level of weave density for good surface smoothness so that all the running side warps and wefts are present under the paper-making side warps and wefts in parallel.

Preferable yarn diameter of any auxiliary weft is smaller than that of a paper-making side weft for good surface smoothness. The range of most preferable yarn diameters of an auxiliary weft is generally from 70 to 90% of that of a paper-making side weft, but the proportion depends on weave patterns.

It is also preferable to use a yarn larger in diameter for both running side warps and wefts compared with paper-making side warps and wefts from the viewpoints of abrasion resistance and stiffness.

Preferable examples of the yarn material include polyester monofilament, polyamide monofilament and polyphenylene sulfide monofilament. Especially for a warp yarn, polyamide monofilament may preferably be used from the viewpoints of stiffness and size stability. Mixed yarns of a polyamide monofilament and a polyester monofilament are preferable for running side wefts from an abrasion resistance point of view. A polyamide monofilament is preferable for an auxiliary weft from an internal abrasion resistance point of view. On the other hand, polyphenylene sulfide monofilament is effective in cases where heat resistance is required.

If the same weave pattern is used for both paper-making side woven fabric and running side woven fabric, an advantage of better adhesion between the two fabrics can be obtained.

The positions where a pair of auxiliary wefts is placed are not specifically limited. It is preferable, however, for the pair to be placed at concave parts of a paper-making side woven fabric to make a paper-making surface of the fabric smoother.

One of examples of the concave parts is those positions where warps are extended over wefts. Another example of the concave parts is those where warps sink.

Formation of flat surfaces of auxiliary wefts is also effective to make the surface smoother. For example, the auxiliary wefts are placed over at least two warps running over adjacent wefts.

Now, embodiments of the present invention are explained in accordance with drawings.

FIGS. 1, 4, 5, and 6 are design diagrams illustrating repeating units of examples of the present invention.

Figure 2:
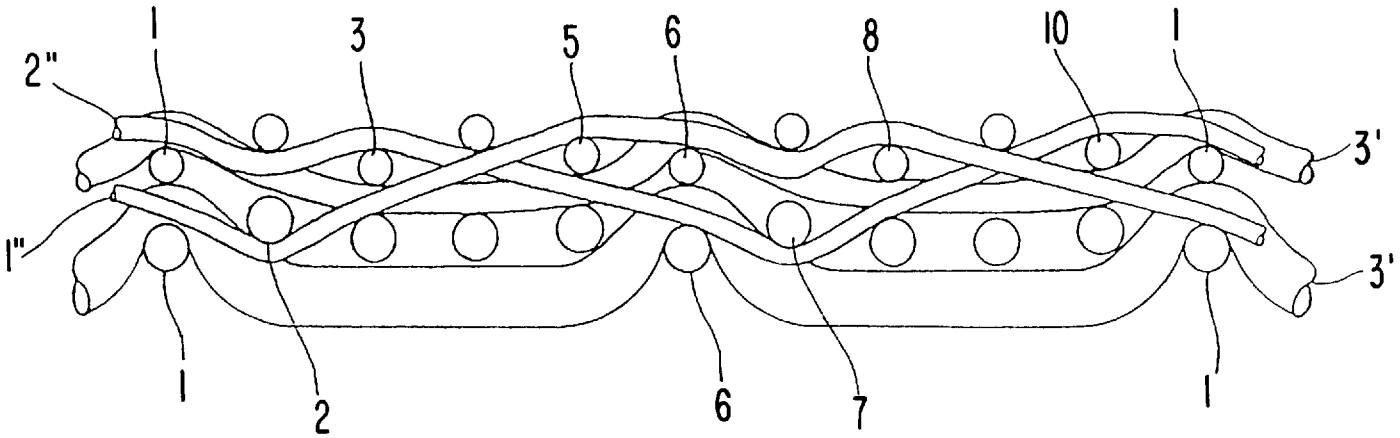
FIG. 2 is a cross-sectional view taken along a line 2—2 of FIG. 1.
Figure 3:
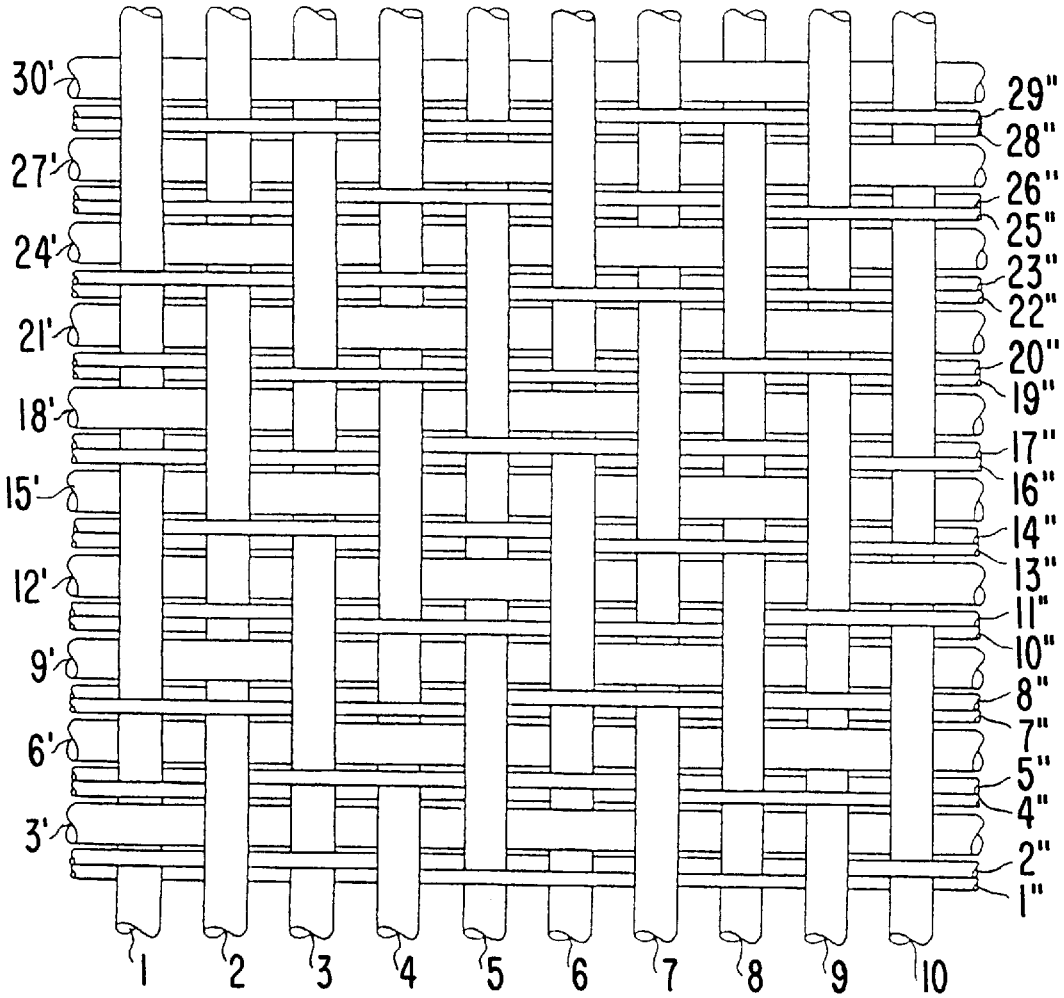
FIG. 3 is a plan view of the paper-making side of FIG. 1.

FIG. 2 is a cross-sectional view along weft taken at a line 2—2 of FIG. 1; FIG. 3 is a plan view of paper-making side of the example shown in FIG. 1.

In respective design diagrams, a warp is shown in Arabic numerals; e.g., 1, 2 or 3. The same number is given for both a paper-making side warp and a running side warp placed in the same vertical position.

A weft is shown in an Arabic numeral with a prime, e.g., 1', 2' or 3'. The same numeral is given for both a paper-making side weft and a running side weft placed in the same vertical position.

An auxiliary weft is shown in an Arabic numeral with a double prime, e.g., 1", 2" or 3".

Mark x in a box in the drawings shows the position where a paper-making side warp is placed over a paper-making side weft. Mark ○ in a box shows the position where a running side warp is placed under a running side weft and is woven together with the paper-making side weft. Mark ▲ in a box shows the position where an auxiliary weft is placed over a paper-making side warp, filling a concave portion on the paper-making face and connecting the paper-making side woven fabric with the running side woven fabric. Mark Δ in a box shows the position where an auxiliary weft is placed under a running side warp and connects the running side woven fabric with the paper-making side woven fabric. A blank box in the drawings shows the position where an auxiliary weft is running between a paper-making side warp and a running side warp.

The example shown in FIG. 1 consists of a five-shaft paper-making side woven fabric and a five-shaft running side woven fabric having the same weave pattern. The auxiliary wefts in FIG. 1 fill concave portions on the paper-making side fabric and connect woven fabrics of both sides.

The repeating unit shown in FIG. 1 has ten warps and ten wefts because a repeating unit formed by an auxiliary weft contains twice as many warps as the number of paper-making side warps in a repeating unit of the paper-making side fabric (five and which is equivalent number to the shaft number of the paper-making side fabric).

In this context, if a paper-making woven fabric is a three-shaft fabric, then the repeating unit of the auxiliary weft contains six warps in this invention. similarly, if a paper-making fabric is a four-shaft fabric, then the repeating unit of the auxiliary weft contains eight warps in this invention.

In the woven fabric having a repeating unit of the present invention shown in FIG. 1 but not limited to FIG. 1, consequently, four repeating units of the paper-making side woven fabric and the running side woven fabric excluding auxiliary wefts are used in total; namely, two repeating units in the warp direction and two in the weft direction.

As previously mentioned, reference numerals 1, 2, 3 . . . 10 are used to denote the paper-making side warps and running side warps in FIGS. 1 to 3. Both warps and wefts of both side fabrics are placed in the same vertical position in the same weave density in the repeating unit shown in FIGS. 1 to 3.

Reference numerals 3', 6', 9', 12', 15', 18', 21', 24', 27', 30' are used to denote the paper-making side wefts and running side wefts. Both wefts are placed in the same vertical position in the same weave density in the repeating unit shown in FIGS. 1 and 3.

Reference numerals 1", 2", 4", 5", 7", 8", 10", 11", 13", 14", 16", 17", 19", 20", 22", 23", 25", 26", 28" and 29" are used to denote auxiliary wefts. The auxiliary wefts, 1" and 2", 4" and 5", 7" and 8", 10" and 11", 13" and 14", 16" and 17", 19" and 20", 22" and 23", 25" and 26", 28" and 29", respectively, form pairs of the auxiliary wefts. It is understood, consequently, that each pair of auxiliary wefts is placed adjacent to each of wefts in both paper-making and running sides fabrics.

First, the paper-making side woven fabric shown in FIGS. 1 through 3 is illustrated in the warp direction. Paper-making side warp 1, as shown in FIGS. 1 and 3 runs in the repeating unit under paper-making side weft 3' and then over four paper-making side wefts 6', 9', 12' and 15'. It continues to run under paper-making side weft 18' and then over four paper-making side wefts 21', 24', 27' and 30'. Paper-making side warps 6 runs in the same manner. It is understood that, as being a five-shaft repeating unit having a long crimp of warp on the paper-making side, a paper-making side warp is woven once by passing under one paper-making side weft and then disposed over consecutive four paper-making side wefts in a repeating unit to form a long crimp with the length equivalent to four paper-making side wefts. Paper-making side warps 2, 3, 4 and 5 likewise run in the repeating unit by being woven once by different paper-making side wefts, namely, paper-making side wefts 9', 15', 6' and 12', respectively.

It is also understood that, in the repeating unit shown in FIGS. 1 and 3, two crimps of the paper-making side warp 1 are formed with paper-making side wefts 6', 9', 12' and 15' and 21', 24', 29' and 30'. Likewise, the paper-making side warp 2 forms two long crimps with paper-making side wefts 12', 15', 18' and 21' and 27', 30', 3' and 6', each of which is with the length equivalent to four paper-making side wefts on the paper-making side, after being woven by two paper-making side wefts 9' and 24'. As stated above, one of the two long crimps formed by the warp 2 is the one which the warp 2 is running over paper-making wefts 12', 15', 18' and 21', and the other is the one which the warp 2 is running over paper-making wefts 27', 30', 3' and 6'. The last two wefts 3' and 6' are those of a repeating unit adjacent and continuing to the repeating unit shown in FIGS. 1 and 3.

It is noted that the woven positions of paper-making side warp 2 is shifted by two paper-making side wefts from the woven positions of adjacent paper-making side warp 1. Paper-making side warps 3 through 10 are likewise placed.

Second, the running side woven fabric is extended in the weft direction. As stated above, the running side woven fabric excepting auxiliary wefts has the same repeating unit as that of the paper-making side woven fabric. As shown in FIGS. 1 and 2, running side weft 3' is woven by running side warps 1 and 6 into fabric and then runs under running side warps 2, 3, 4, and 5. The running side weft 3' continues to run under running side warps 7, 8, 9 and 10 to form two long crimps on the running side. The length of each of the long crimps is equivalent to approximately four running side warps.

Likewise, each of other running side wefts 6', 9', 12', 15', 18', 24' and 30', forms two long crimps with the length of four running side warps on the running side in the repeating unit of FIG. 1. It is understood that the running side woven fabric is formed as a weft-wearing type where each of the wefts of the running side woven fabric has a long crimp with the length of four running side warps on the running side.

It is also apparent that the running side warps form a long crimp with the length of four running side wefts on the reverse side, (the paper-making side), in this example, and that the weave pattern of the running side woven fabric is the same as that of the paper-making side woven fabric. Likewise, the paper-making side woven fabric and the running side woven fabric have crimps formed at the same positions.

Since both the paper-making side and running side woven fabrics have the same weaving pattern, this example produces preferable results that both the paper-making side woven fabric and the running side woven fabric have closer contact and that the total thickness of the fabrics can be thinner, and that they have less water holding property than the case where weaving patterns of both woven fabrics are different. Of course, the present invention is not limited to this example. Weave density of warps and wefts of the running side woven fabric may be the same or coarser than that of the paper-making side woven fabric.

Third, the auxiliary wefts are now described. In the example shown in FIGS. 1 and 2, two auxiliary wefts which comprise one pair are placed in all the places between each of the paper-making side wefts. For example, auxiliary wefts 1" and 2" comprising one pair are placed between paper-making side wefts 3' of FIG. 1 and (not shown) paper-making side weft 30', which is contained in a repeating unit (not shown) adjacent and connected to auxiliary weft 1" of FIG. 1. In this example, the paper-making side warp 3 runs from under the paper-making side weft 30' to over the adjacent paper-making side weft 3'. On the other hand, paper-making side warp 6 which is not adjacent to the warp 3 runs downward from over the paper-making side weft 30' to under the adjacent paper-making side weft 3'. In this example, paper-making side warps 3 and 6 cross between paper-making side wefts 30' and 3'. One of the auxiliary wefts, 1" and 2", is disposed over either one of paper-making side weft 3 or 6. Paper-making side warp 5 sinks downward at the middle position of the crimp between paper-making side wefts 27' (included in the adjacent repeating unit not shown) and 12' (shown) between paper-making side warps 3 and 6. The auxiliary weft 1" is placed on this paper-making side warp 5 between paper-making side wefts 30' (not shown) and 3' which is the middle position of the crimp of the warp 5. Likewise, paper-making side warp 8 runs upward from under paper-making side weft 30' of the adjacent repeating unit (not shown) connected to the repeating unit of FIG. 1 at its bottom, and then runs over the adjacent paper-making side weft 3'. Paper-making side warp 1 (in the repeating unit not shown and adjacent to the repeating unit of FIG. 1 connected to the right side) which is not adjacent to paper-making side warp 8 runs downward from over the paper-making side weft 30' to under the adjacent paper-making side weft 3'. The paper-making side warps 8 and 1 cross each other between the paper-making wefts 30' and 3'. Auxiliary weft 2" is placed over the paper-making side warp 1 at the position where the paper-making side warp 1 runs from over the paper-making weft 30' to under the paper-making side weft 3'. Paper-making side warp 8 runs from under the paper-making side weft 30' to over the paper-making weft 3'. Then, auxiliary weft 1" is placed over the paper-making side warp 8 between the paper-making wefts 30' and 3'. On the other hand, paper-making side warp 10 sinks downward at the middle position of the crimp between the paper-making side wefts 27' and 2' by being woven with paper-making side wefts 27' and 12' (of the adjacent repeating unit not shown) between paper-making side warps 8 and 1 (of the adjacent repeating unit not shown). The auxiliary weft 2" is placed over this paper-making side warp 10 between paper-making side wefts 30' and 3' which is in the middle position of the crimp of warp 10. Thus, placement of a pair of auxiliary wefts smoothens the paper-making face.

Respective to a pair of auxiliary wefts is now described with reference to FIGS. 1 and 2. Auxiliary weft 1" runs over the paper making side warps 5, 6 and 8 and under the running side warp 2. In other warp zones, auxiliary weft 1" runs between the paper-making side warps and the running side warps. The running route of auxiliary wefts 1" and 2" is now explained. As shown in the repeating unit of FIG. 1 and FIG. 2, auxiliary weft 1" begins to run in the repeating unit between paper-making side warp 1 and running side warp 1, passes under running side warp 2 and continues to run between two paper-making side warps 3 and 4 and two running side warps 3 and 4. Further, auxiliary 1" continues to run over the paper-making side warps 5 and 6 which are adjacent to each other, and between paper-making side warp 7 and running side warp 7. Again, the auxiliary weft 1" runs over paper-making side warp 8 and continues to run between consecutive three paper-making side warps 9, 10 and 1 (of adjacent repeating unit) and running side warps 9, 10 and 1 (of adjacent repeating unit).

Auxiliary weft 2" runs over paper-making side warps 1, 3 and 10 and under running side warp 7. Auxiliary weft 2" likewise travels between the paper making side warps and the running side warps in other warp zones.

Regarding the running route of auxiliary weft 2", auxiliary weft 2" runs entirely in the same way as the auxiliary weft 1" and has entirely the same weave pattern. The only difference of running routes of auxiliary wefts 1" and 2" is that the weaving positions of the auxiliary weft 2" is shifted from the weaving positions of the auxiliary weft 1" by five paper-making side warp distances in the repeating unit.

In this manner, auxiliary weft 1" functions as an auxiliary weft as originally required (e.g., filling concave portion) by passing over and weaving together the paper making side warps 5, 6 and 8 and functions as a binding yarn by passing under running side warp 2 and connecting the running side woven fabric to the paper-making side woven fabric, similarly auxiliary weft 2" functions as an auxiliary weft as originally required (e.g., filling concave portion) by passing over and weaving together the paper-making side warps 1, 3 and 10 and functions as a binding yarn by passing under running side warp 7 and connecting the running side woven fabric to the paper-making side woven fabric. When the auxiliary weft 1" is woven by the paper-making side warps 5, 6 and 8, the auxiliary weft 2" is placed downward to the running side, goes under the running side warp 7 and is woven by the running side warp 7.

When the auxiliary weft 2" is woven by the paper-making side warps 10, 1 and 3, the auxiliary weft 1" is placed downward to the running side and is woven by the running side warp 2 to function as a binding yarn by connecting the running side woven fabric to the paper-making side fabric.

Thus, the woven patterns formed by the auxiliary wefts 1" and 2" appear once each alternately on the paper making side surface in the repeating unit; thereby, one auxiliary weft functions as an auxiliary weft once, while the other functions as a binding yarn once in the repeating unit. The number of warps placed between the positions where the first and second auxiliary wefts pass under running side warps shown in Δ is one less than the number of the shafts of the paper-making side woven fabric.

Other pairs of auxiliary wefts such as 4" and 5", 7" and 8", 10" and 11", 13" and 14", 16" and 17", 19" and 20", 22" and 23", 25" and 26", and 28", and 29" are also placed in the same manner.

It is not necessary that each of a pair of auxiliary wefts has the same weaving pattern and that a repeating unit of auxiliary wefts has to be the one having twice as many warps as the shaft numbers of a fabric in which the auxiliary weft is to be disposed.

Further, the weaving pattern of either a paper-making side fabric or a running side fabric is not limited to that of any of examples disclosed here.

The auxiliary wefts, however, in the example above have an advantage as to forming smoother paper-making face, since all the auxiliary wefts pull both sides of fabrics in every repeating unit inward with the uniform force, thereby a smooth paper-making side is achieved.

As seen in FIG. 2, the paper-making side weft 3' and the running side weft 3' have the same weave pattern; the running side weft 3' forms long crimps with the length of four warps on the running side; and the auxiliary wefts 1" and 2" appear alternately on the paper-making face and function as the auxiliary wefts. The auxiliary wefts 1" and 2" also alternately connect the paper-making side woven fabrics and the running side woven fabrics and function as the connecting yarns.

It is also seen that the woven positions of the auxiliary wefts 1" and 2" under the running side warps 2 and 7 are positions where the running side warps 2 and 7 are located closest to the paper-making side. This structure makes the binding parts of the running side fabric closer to the paper-making side fabric and keeps them away from the running face. Consequently, the auxiliary wefts are hard to wear out; thereby the abrasion resistance is improved.

While the present invention is not limited to this example and allows that the auxiliary wefts can possibly be woven with and under other warps for connecting two side fabrics. It is preferable that the running side warps are woven at closer positions to the paper-making face by auxiliary wefts in view of abrasion resistance.

FIG. 3 is a plan view of the paper-making side of the example shown in FIG. 1.

As shown in FIG. 3, a pair of auxiliary wefts are used in such a manner that the pair works like substantially one auxiliary weft which fills concave portions once in a repeating unit of the paper-making side fabric. Explanation of the running side woven fabric is omitted here.

Figure 4:
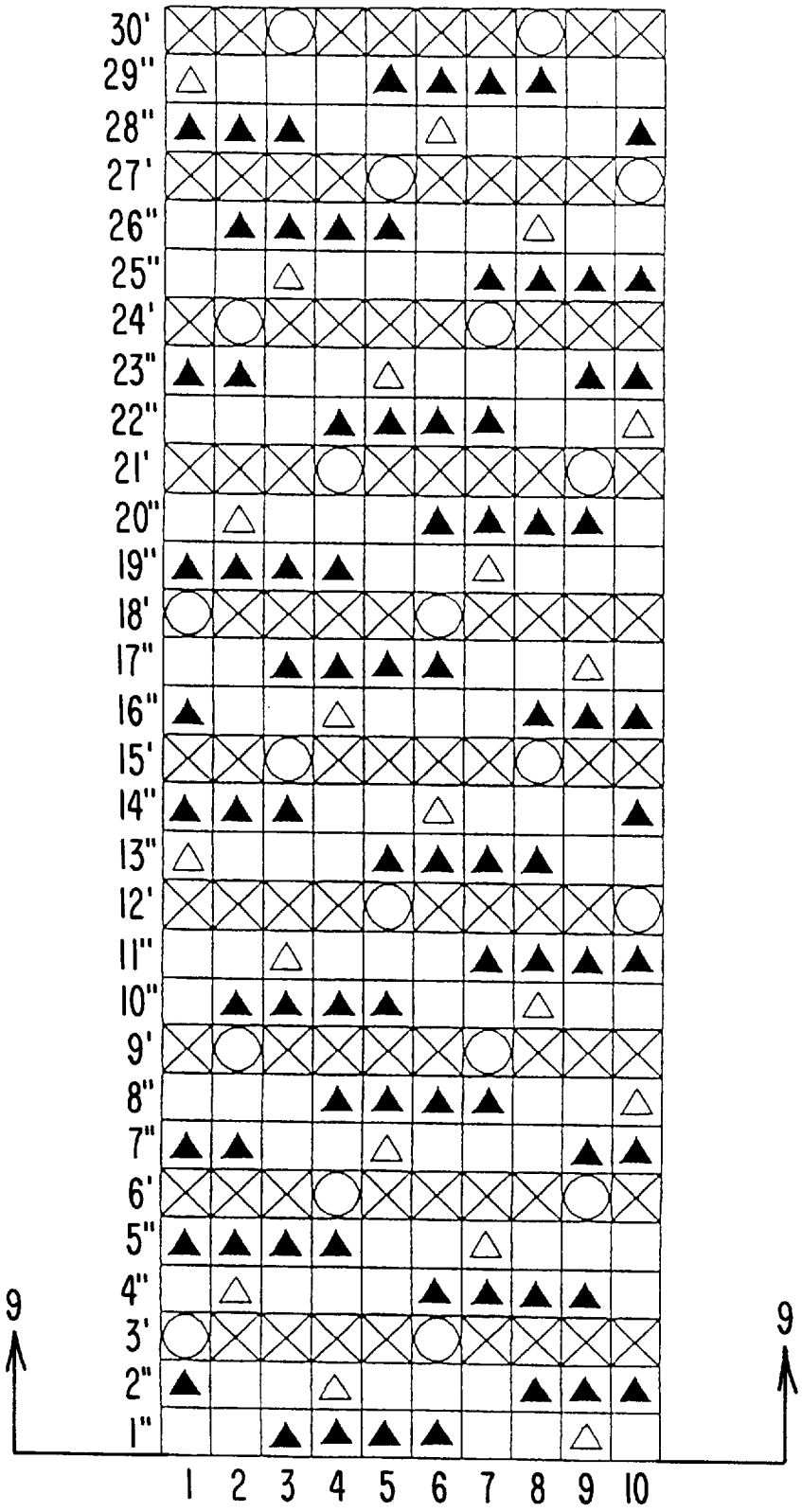
FIG. 4 is a design diagram illustrating a repeating pair of another example of the present invention.

FIG. 4 illustrates another example. Symbols of x, ○, Δ and ▲ in a box and a blank box denote the same as FIG. 1. Further, the paper-making side woven fabric, the running side woven fabric and others are the same as those of example shown in FIG. 1. What is different is the weave pattern of auxiliary wefts. In the case of the example of FIG. 1, an auxiliary weft, when woven together with warps, runs over three paper-making side warps at the locations shown by ▲ and then passes under one running side warp at the locations shown by Δ; In contrast, in the case of example of FIG. 4, the auxiliary weft, when woven together with warps, run over four consecutive paper-making side warps at the locations shown by ▲ and runs under one running side warp at the locations shown by Δ; thereby, a horizontal surface is formed on the paper-making face, which is a characteristic feature of this example. The auxiliary weft 4" is placed over two paper-making side warps 7 and 8 at a location where the two paper-making side warps 7 and 8 run over two adjacent paper-making side wefts 3'and 6'. Likewise, other auxiliary wefts are placed over two paper-making side warps at locations where the two paper-making side warps run over two adjacent paper making side wefts. Placement of more auxiliary wefts over the paper-making warps in this example improves the fiber supporting capability.

Figure 9:
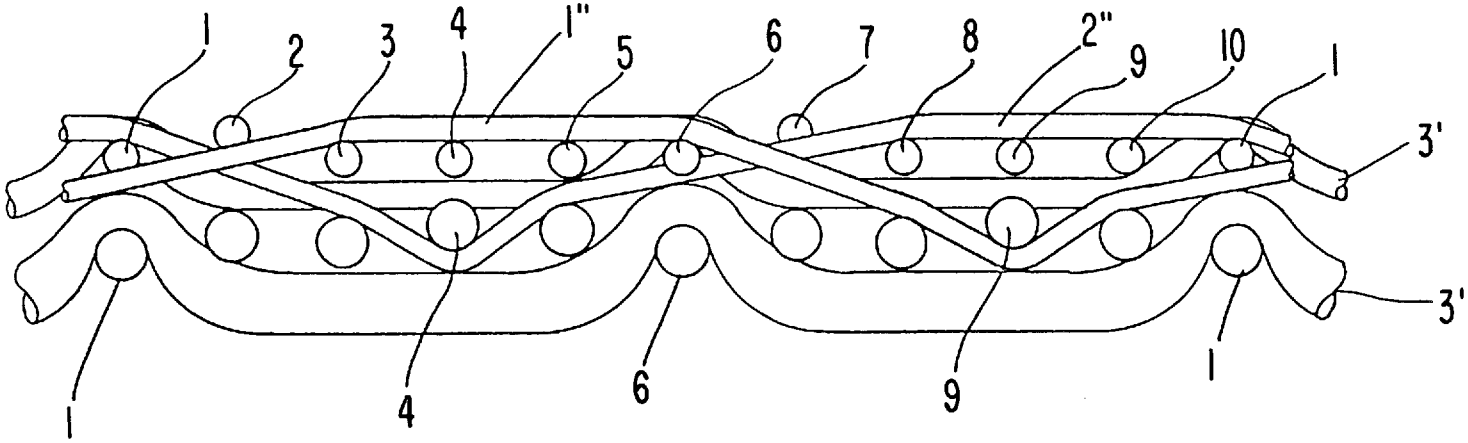
FIG. 9 is a cross-sectional view taken along a line 9—9 of FIG. 4.

FIG. 9 is a cross-sectional view along weft taken at a line 9—9 of FIG. 4. As seen in FIG. 9, the paper-making side weft 3' and the running side weft 3' have the same weave pattern; the running side weft 3' forms long crimps with the length of four warps on the running side; and the auxiliary wefts 1" and 2" appear alternately on the paper-making face and function as the auxiliary wefts. The auxiliary wefts 1" and 2" also alternately connect the paper-making side woven fabrics and the running side woven fabrics and function as the connecting yarns.

It is also seen that the woven positions of the auxiliary wefts 1" and 2" under the running side warps 4 and 9 are positions where the running side warps 4 and 9 are located closest to the paper-making side. This structure makes the binding parts of the running side fabric closer to the paper-making side fabric and keeps them away from the running face. Consequently, the auxiliary wefts are hard to wear out; thereby the abrasion resistance is improved.

Figure 5:
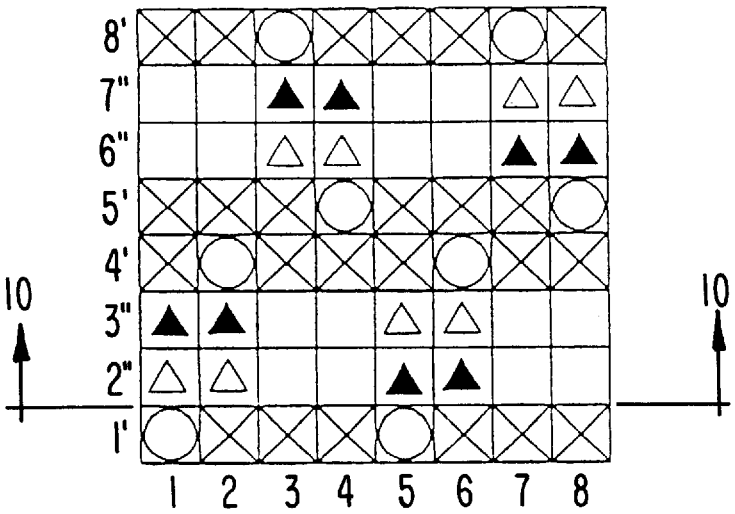
FIG. 5 is a design diagram illustrating a repeating pair of another example of the present invention.

The example shown in FIG. 5 comprises a four-shaft (four wefts and four warps in a repeating unit of a fabric) fabric, both paper-making side and running side woven fabrics of which have the same repeating units excepting auxiliary wefts. In this example, a repeating unit of an auxiliary weft is made twice as many as the shaft number of paper-making and running side fabric, as in the case of previous examples. In this example, one of a pair of auxiliary wefts (e.g., auxiliary weft 2") is placed where a paper-making side warp (e.g., warp 5) runs upward from under a paper-making side weft (e.g., weft 1') to over an adjacent paper-making side weft (e.g., weft 4') and an adjacent warp (e.g., warp 6) runs downward from over the former paper-making weft (e.g., weft 1') to under the latter paper-making weft (e.g., weft 4'); thereby, the pair of auxiliary wefts placed on the crossing part fills concave portion formed on the crossing area shown by ▲.

The other one of the pairs of auxiliary wefts runs under the running side warps at each of the crossing parts of the running side fabric, as shown by Δ in FIG. 5. When one of a pair of auxiliary wefts runs over two paper-making side warps at the places shown by ▲, the other auxiliary weft runs under two running side warps at the same place shown by Δ.

In this example, a pair of auxiliary wefts is not placed on every space between two adjacent paper-making side wefts; rather on every other space, because the weave pattern of FIG. 5 is such that each of the crossing parts is formed on every other space between two adjacent paper-making side wefts.

Figure 10:
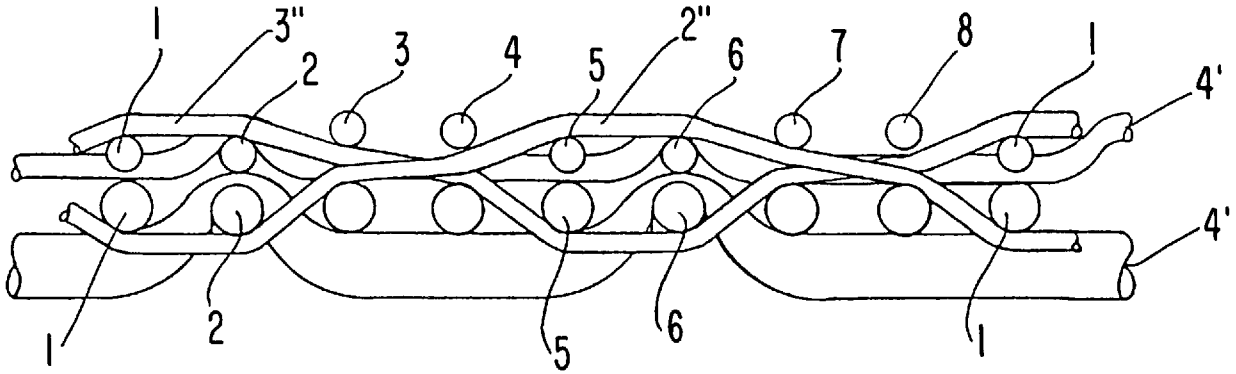
FIG. 10 is a cross-sectional view taken along a line 10—10 of FIG. 5.

FIG. 10 is a cross-sectional view along weft taken at a line 10—10 of FIG. 5. As seen in FIG. 10, the paper-making side weft 4' and the running side weft 4' have the same weave pattern; the running side weft 4' forms long crimps with the length of four warps on the running side; and the auxiliary wefts 2" and 3" appear alternately on the paper-making face and function as the auxiliary wefts. The auxiliary wefts 2" and 3" also alternately connect the paper-making side woven fabrics and the running side woven fabrics and function as the connecting yarns.

Figure 6A:
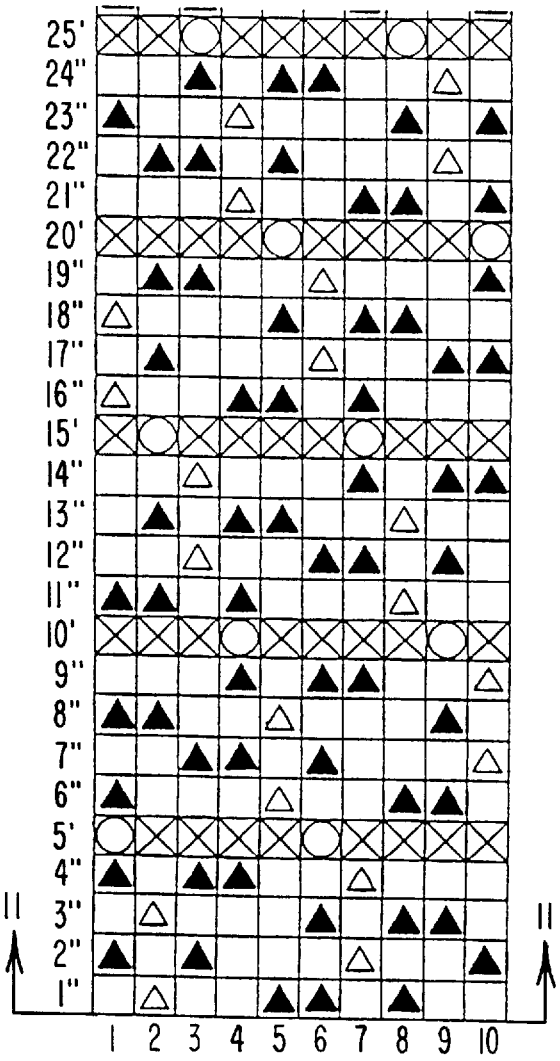
FIGS. 6A and 6B are design diagrams illustrating a repeating pair of another example of the present invention.
Figure 6B:
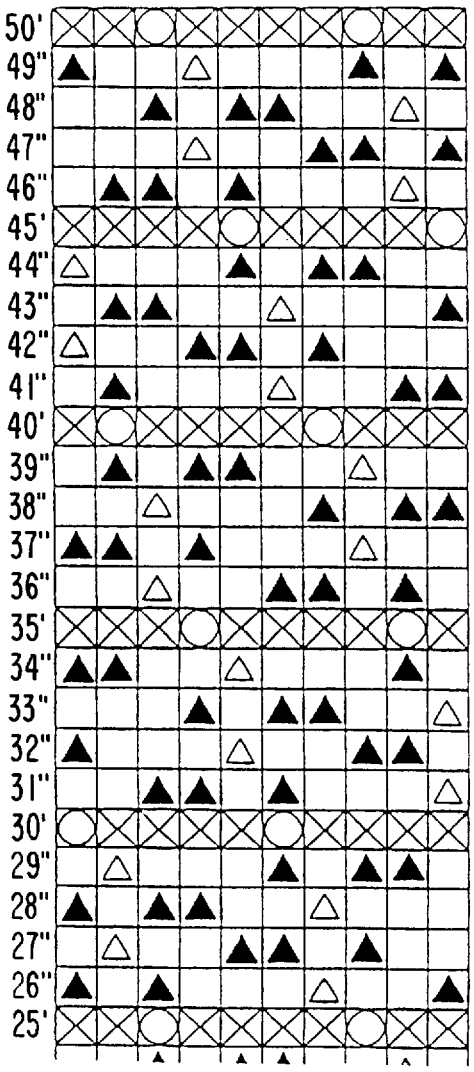

FIGS. 6A and 6B show an example in which two pairs of the auxiliary wefts are placed between wefts. Since the repeating units of this example are so large, the lower weave pattern is shown in FIG. 6A and the upper one in FIG. 6B, being cut at weft 25'. For example, a pair of auxiliary wefts 6" and 7" and another pair of auxiliary wefts 8", and 9" are placed between wefts 5' and 10'. Likewise, a pair of auxiliary wefts 11" and 12" and another pair of auxiliary wefts 13" and 14" are placed between wefts 10' and 15'. It is observed that each one of two pairs of auxiliary wefts is placed at the portion shown by ▲ where one paper-making side warp runs from over a first weft to under a second weft adjacent to the first weft crossing another warp which runs from under the first weft to over the second weft, and runs also on the portions where warps sink by being woven together with wefts; thereby, the paper-making surface of the fabric is made flat and smooth. Each of the auxiliary wefts is woven together with a running side warp once in a repeating unit at the place shown by Δ.

In this example shown in FIGS. 6A and 6B, auxiliary weft pairs of different weave patterns are placed. The patterns of both pairs are like an image pattern and its mirror image pattern or reverse patterns with each other. However, the pairs of the same weave pattern can be placed.

Figure 11:
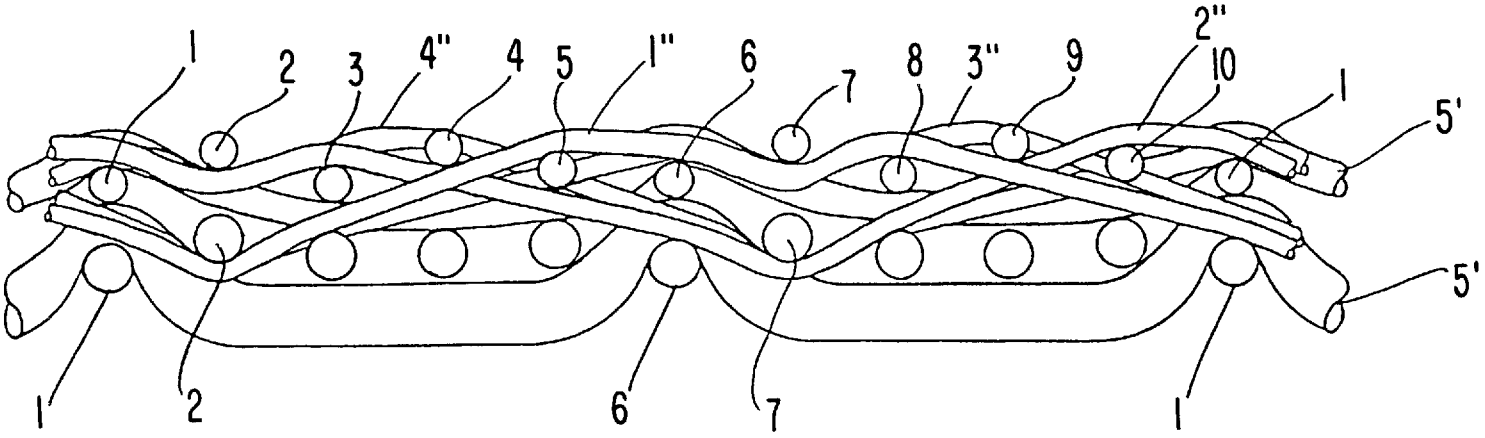
FIG. 11 is a cross-sectional view taken along a line 11—11 of FIG. 6.

FIG. 11 is a cross-sectional view along weft taken at a line 11—11 of FIG. 6A. As seen in FIG. 11, the paper-making side weft 5' and the running side weft 5' have the same weave pattern; the running side weft 5' forms long crimps with the length of four warps on the running side. One of two pairs of the auxiliary wefts 1" and 2" appear alternately on the paper-making face and function as the auxiliary wefts and binding yarns. The other one of two pairs of auxiliary wefts 3" and 4" appear alternately, in the pattern different from that of the auxiliary wefts 1" and 2" as discussed above, on the paper-making face and also function as the auxiliary wefts and binding yarns.

Figure 7:
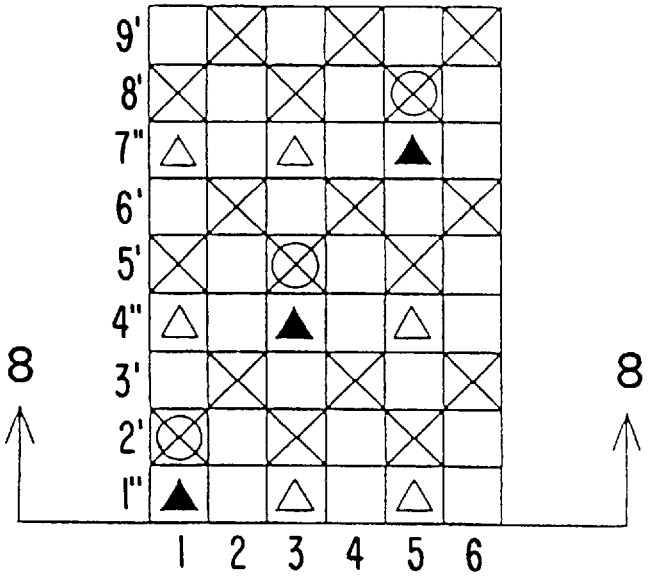
FIG. 7 is a design diagram illustrating a repeating pair of a conventional example.
Figure 8:
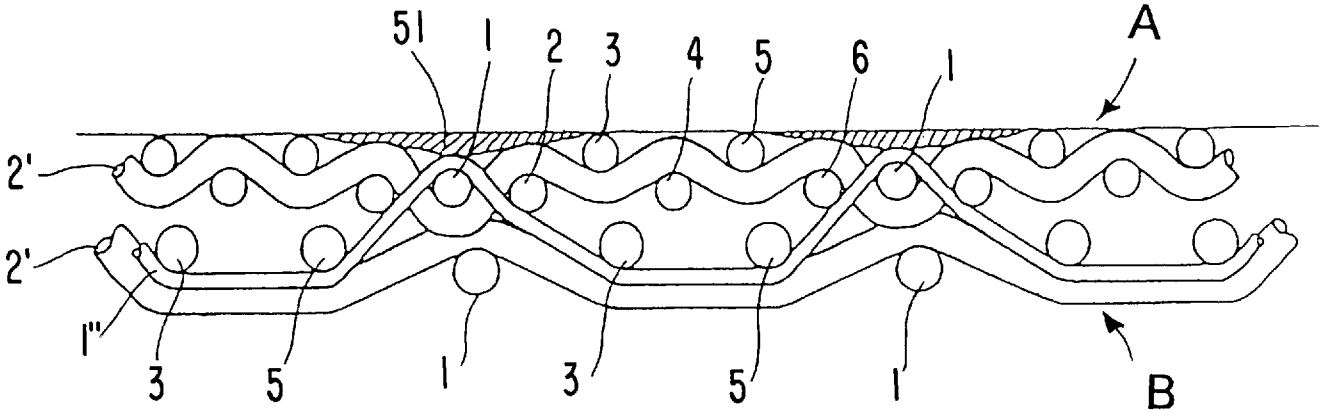
FIG. 8 PRIOR ART
FIG. 8 is a cross-sectional view taken along a line 8—8 of FIG. 7.

FIG. 7 is a design diagram illustrating a repeating unit of a conventional two-layer woven fabric as an example.

Now, advantageous effect of the present invention is illustrated by a comparison test, in which the woven fabric for paper-making shown as an example of the present invention in FIG. 1, is compared with an example of a conventional woven fabric for paper-making shown in FIG. 7. Woven fabric structure and the test results are shown in Table 1.

TABLE 1

| | Example of the Invention | Conventional Example |
|---|---|---|
| PAPER-MAKING SIDE | | |
| Warp | | |
| Material | PET | PET |
| Diameter (mm) | 0.17 | 0.17 |
| Density (pcs/inch) | 70 | 70 |
| Weft | | |
| Material | PET | PET |
| Diameter (mm) | 0.20 | 0.17 |
| Density (pcs/inch) | 50 | 70 |
| Auxiliary weft | | |
| Material | P.A. | |
| Diameter (mm) | 0.12 | |
| Density (pcs/inch) | 100 | |
| RUNNING SIDE | | |
| Warp | | |
| Material | PET | PET |
| Diameter (mm) | 0.20 | 0.20 |
| Density (pcs/inch) | 70 | 35 |
| Weft | | |
| Material | PET, P.A. | PET, P.A. |
| Diameter (mm) | 0.30 | 0.30 |
| Density (pcs/inch) | 50 | 35 |
| Binding yarn | | |
| Material | | PET |
| Diameter (mm) | | 0.12 |
| Density (pcs/inch) | | 35 |
| Sheet fineness (sec) | 93 | 75 |
| Wire Marks | No | Yes |

Sheet fineness: A sheet of paper corresponding to 70 g/m$^2$ weight was made from raw pulp for medium quality paper formulation by a TAPPI standard sheet test machine, followed by preparation of a fine sheet according to a conventional method. Measurement of the paper surface which contacted the woven fabric face was carried out by using a Beck fineness meter.
Wire mark was visually determined.

In the conventional example, the paper made had thick portions at concave portions on the parts connecting fabrics of both side fabrics. This thick portion appeared as a diagonally continuous black line. The paper according to the present invention did not create such marks.

The paper-making side woven fabric according to the present invention is a woven fabric which connects two-layer woven fabric integrally with the paper-making side and the running side by use of respectively independent warp and weft; therein, auxiliary weft, which fills concaves on the paper-making side woven fabric for bringing the paper-making faces smoother, also functions as a binding yarn. In this way, concave portions by conventional binding yarns are not created and excellent surface smoothness is realized. Practical paper-making with the fabric produces paper of improved quality having excellent sheet smoothness.

In addition, the two-layer woven fabric has excellent adhesion between the two layers and no internal abrasion of the connecting auxiliary weft is created, since the auxiliary weft as a binding yarn consists of the two pieces to form a unit and has greater binding force than a conventional single binding yarn.

Another effect is smaller water holding due to possible thinner woven fabric.

What is claimed is:

1. A two-layer woven fabric for paper-making comprising:

a paper-making side which has paper-making side warps and wefts, wherein long crimps of said warps are formed on said paper-making side surface;

a running side which has running side warps and wefts; and a pair of first and second auxiliary wefts placed between two adjacent paper-making side wefts and two adjacent running side wefts each woven by a paper-making side warp and a running side warp to connect the paper-making side and the running side; wherein the first auxiliary weft runs over a first paper-making side warp where the second auxiliary weft runs under a first running side warp at a first position and the first auxiliary weft runs under a second running side warp at a second position where the second auxiliary weft runs over a second paper-making side warp.

2. A two-layer woven fabric for paper-making according to claim 1, wherein said paper-making woven fabric comprises a first repeating unit of three or more shafts.

3. A two-layer woven fabric for paper-making according to claim 2, wherein the number of warps placed between the first and second positions is one less than the number of the shafts of the first repeating unit.

4. A two-layer woven fabric for paper-making according to claim 2, wherein the first repeating unit comprises four shafts.

5. A two-layer woven fabric for paper-making according to claim 2, wherein the first repeating unit comprises five shafts.

6. A two-layer woven fabric for paper-making according to claim 2, wherein the first auxiliary weft comprises a second repeating unit and the second auxiliary weft comprises a third repeating unit between the paper-making side warps and running side warps, a pattern formed by either the second or the third repeating unit appears on the paper-making surface once on the first repeating unit.

7. A two-layer woven fabric for paper-making according to claim 6, wherein the second and the third repeating units being the same pattern.

8. A two-layer woven fabric for paper-making according to claim 6, wherein the second repeating unit being a reverse pattern of the third repeating unit.

9. A two-layer woven fabric for paper-making according to claim 6, wherein number of warps which comprise the second repeating unit and the third repeating unit is twice as many number of warps which comprise the first repeating unit, the second and third repeating units being shifted by the same number of warps of the first repeating unit.

10. A two-layer woven fabric for paper-making according to claim 2, wherein the running side woven fabric has the first repeating unit.

11. A two-layer woven fabric for paper-making according to claim 1, wherein the first paper-making side warp is extended over the first running side warp.

12. A two-layer woven fabric for paper-making according to claim 1, wherein the first paper-making side warp is extended over a running side warp adjacent to the first running side warp.

13. A two-layer woven fabric for paper-making according to claim 1, wherein each of the first and second auxiliary wefts is woven by a running side warp disposed in closest proximity to the paper-making side surface by crossing and passing under the running side warp.

14. A two-layer woven fabric for paper-making according to claim 1, wherein the pair of auxiliary wefts is placed adjacent to each of the paper-making side wefts.

15. A two-layer woven fabric for paper-making according to claim 1, wherein the pair of auxiliary wefts is placed adjacent to every alternate paper-making side weft.

16. A two-layer woven fabric for paper-making according to claim 1, wherein two or more pairs of auxiliary wefts are placed adjacent to each of the paper-making side wefts.

17. A two-layer woven fabric for paper-making according to claim 15, wherein each of the two or more pairs of auxiliary wefts is different in repeating units forming different weaving patterns.

18. A two-layer woven fabric for paper-making according to claim 1, wherein the running side is of a weft-wearing type in which long crimps of the running side wefts are formed on a running side surface.

19. A two-layer woven fabric for paper-making according to claim 1, wherein the paper-making side warps and running side warps are identical in weave density with the paper-making side wefts and running side wefts.

20. A two-layer woven fabric for paper-making according to claim 1, wherein the first and second auxiliary wefts are smaller in diameter than the paper-making side weft.

21. A two-layer woven fabric for paper-making according to claim 1, wherein the first and second auxiliary wefts are polyamide monofilaments.

22. A two-layer woven fabric for paper-making according to claim 1, wherein the first auxiliary weft is placed over a third paper-making side warp where the third paper-making side warp runs from over a first paper-making side weft and to under a second paper-making side weft which is disposed adjacent to the first paper-making side weft, and the first auxiliary weft is placed over a fourth paper-making side warp where the fourth paper-making side warp runs from under the first paper-making side weft to over the second paper-making side weft.

23. A two-layer woven fabric for paper-making according to claim 22, wherein the third paper-making side warp is extended adjacent to the second paper-making side warp.

24. A two-layer woven fabric for paper-making according to claim 22, wherein at least one paper-making side warp is extended between the third and fourth paper-making side warps.

25. A two-layer woven fabric for paper-making according to claim 1, wherein the first auxiliary weft is placed over at least two paper-making side warps at a location where the at least two paper-making side warps run over two adjacent paper-making side wefts.

26. A two-layer woven fabric for paper-making according to claim 1, wherein the first or second auxiliary weft is placed over a fifth paper-making side warp where the fifth paper-making warp runs from over a first paper-making side weft to under a second paper-making side weft disposed adjacent to the first paper-making side weft and is placed over a sixth paper-making side warp which is disposed not adjacent to the fifth paper-making side warp and which runs from under the first paper-making side weft to over the second paper-making side weft; and either the first or second auxiliary weft is further placed over a seventh paper-making side warp which runs between the fifth and sixth paper-making side warps and is pulled downward by a paper-making side weft.

* * * * *